US006499780B2

(12) United States Patent
Bingman

(10) Patent No.: US 6,499,780 B2
(45) Date of Patent: Dec. 31, 2002

(54) SOFT SIDED GUN CASE WITH RETRACTABLE LEGS

(75) Inventor: Richard Perry Bingman, Larkspur, CO (US)

(73) Assignee: Brooks & Thomas, Inc, Colorado Springs, CO (US)

( * ) Notice: Subject to any disclaimer, the term of this patent is extended or adjusted under 35 U.S.C. 154(b) by 0 days.

(21) Appl. No.: 09/846,664

(22) Filed: May 1, 2001

(65) Prior Publication Data

US 2001/0052711 A1 Dec. 20, 2001

Related U.S. Application Data

(60) Provisional application No. 60/201,390, filed on May 3, 2000.

(51) Int. Cl.[7] ..... A45F 5/00

(52) U.S. Cl. ..... 294/142; 294/152; 206/317; 224/913; 248/171

(58) Field of Search ..... 294/141–143, 294/149, 152, 169; 206/317; 224/913; 211/64, 70.1, 70.2, 85, 203; 248/96, 150, 152, 160, 171, 439, 174

(56) References Cited

U.S. PATENT DOCUMENTS

| | | | | |
|---|---|---|---|---|
| 2,574,730 A | * | 11/1951 | Crew et al. | 190/903 |
| 3,195,844 A | * | 7/1965 | Roepke | 206/315.7 |
| 3,477,586 A | * | 11/1969 | Haluska | 211/64 |
| 3,865,166 A | * | 2/1975 | Pedro | 206/317 |
| 5,626,379 A | | 5/1997 | Scott | 294/143 |
| 5,718,401 A | * | 2/1998 | Walters | 248/150 |

* cited by examiner

*Primary Examiner*—Dean J. Kramer
(74) *Attorney, Agent, or Firm*—Dale B. Halling

(57) ABSTRACT

A gun case with retractable legs includes a gun case that has a top and a bottom and is capable of enclosing a gun. A frame is connected to the bottom of the gun case. The frame has an upper end and a grounded end, a first leg and a second leg are pivotally held at a pivot point to the frame. Each leg has a pivoted end, pivotally attached to the frame, and a foot. Each leg is movable from a closed position, wherein it lies against the bottom of the gun case, to an open position, wherein it is pivoted away from the bottom of the gun case and the foot of the first leg being moved away from the foot of the second leg.

13 Claims, 2 Drawing Sheets

SOFT SIDED GUN CASE WITH RETRACTABLE LEGS

RELATED APPLICATIONS

This application claims priority from provisional application No. 60/201,390, which was filed on May 3, 2000 by the same inventor.

FIELD OF THE INVENTION

The present invention relates generally to the field of soft sided gun cases with retractable legs.

BACKGROUND OF THE INVENTION

Gun cases, particularly soft sided gun cases, are the standard means for sportsmen to carry firearms from one location to another. Once the sportsman arrives at his destination, however, these cases often fail to protect the firearm adequately. When the case is laid on the ground, in a blind, or in a boat, it may offer little protection from standing water, rain, dirt, and other hazards. Leaning a gun case, particularly a soft gun case, against the side of a blind or boat is an unstable proposition at best, and leaves the firearm subject to damage when the case slips and falls. In that position, it is far too easy for an excited dog or clumsy boot to knock over. In addition, a sportsman may need ready, immediate access to the firearm. It is not a practical matter to hold a firearm during every moment in the field. The weather may be too cold, or other tasks may need to be performed yet the sportsman may need ready access to the firearm. A gun case laying on the ground or in the bottom of a boat is not readily accessible when the sportsman is looking to the sky at a flock of approaching geese.

Firearms stands are commonly available at many shooting ranges. Such stands are convenient for temporary storage of firearms between shooting events. However, such stands are typically not portable and offer little or no protection to the firearm from the elements.

Thus, there is a need for a gun case that retains the easily transportable properties of traditional gun cases, yet affords ready access to the firearm in a stable, upright position, significantly reducing the likelihood of damage from falling, and increasing the accessibility of the firearm.

DETAILED DESCRIPTION OF THE DRAWINGS

A soft sided gun case with retractable legs comprises a gun case, and a pair of retractable legs connected to a bottom of the gun case.

Figure 1:
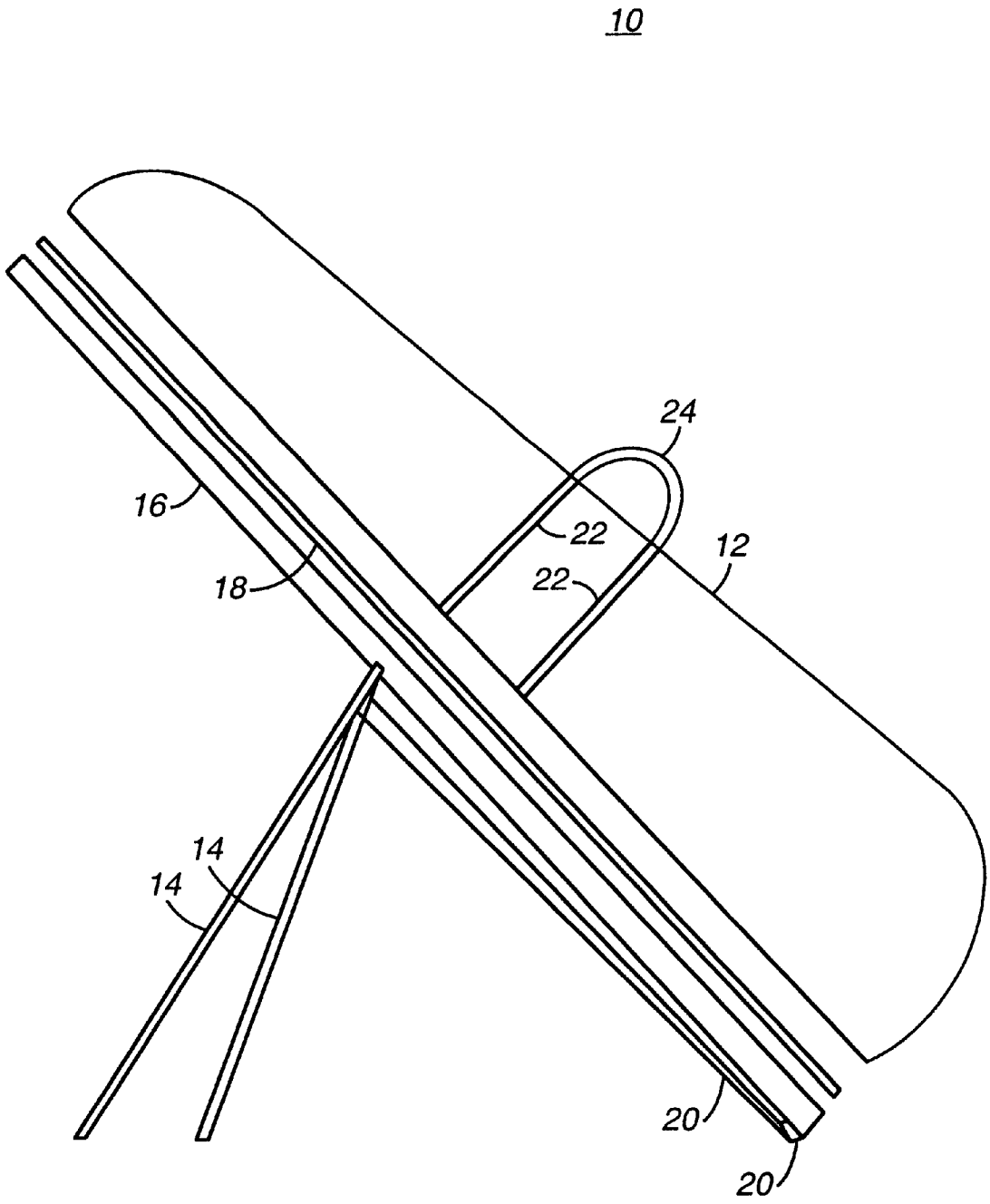
FIG. 1 is a cartoon drawing depicting the implementation of a soft sided gun case with retractable legs in accordance with one embodiment of the invention.

FIG. 1 is a cartoon drawing 10 depicting the implementation of a soft sided gun case with retractable legs in accordance with one embodiment of the invention. The device comprises a gun case 12 and a pair of retractable legs 14 connected to a bottom of the gun case 12. In one embodiment the device further comprises a containment sleeve 16 attached along the bottom of the gun case 12. The containment sleeve 16 may be made of sturdy material, such as canvas or nylon webbing which will increase the device's durability in the field. The containment sleeve 16 contains a spine 18. The spine 18 adds extra rigidity to the device, for maximum support and protection of an enclosed firearm and to aid the device in standing upright. In another embodiment the device further comprises a trigger mechanism 20 connected to the spine 18, between the spine 18 and the pair of retractable legs 14. The trigger mechanism 20 operates to extend the legs 14 when the trigger is operated. In another embodiment a plurality of lateral supports 22 is connected to the spine 18. The plurality of lateral supports 22 extend across the sides of the gun case 12 from the bottom to the top. The lateral supports 22 act as a cradle for the enclosed firearm. The lateral supports 22 provide support to enclosed firearm and to the sides of the gun case 12 and act to prevent the gun case 12 from falling open so that the enclosed firearm is securely retained. A securely retained firearm increases the safety and convenience of the device. In another embodiment, the lateral supports 22 are incorporated into a set of carrying handles 24. In another embodiment the gun case is a soft sided gun case. A soft sided gun case may be made of heavy, padded material with a fold down the center of the longitudinal axis. The fold acts to form a pocket or enclosure to envelop a firearm. Such a fold further acts as the bottom of the gun case 12 and provides an attachment point for the containment sleeve 16. In another embodiment the pair of retractable legs 14 are spring loaded. The spring loaded feature enables the legs 14 to automatically retract when the gun case is lifted from the ground.

Figure 2:
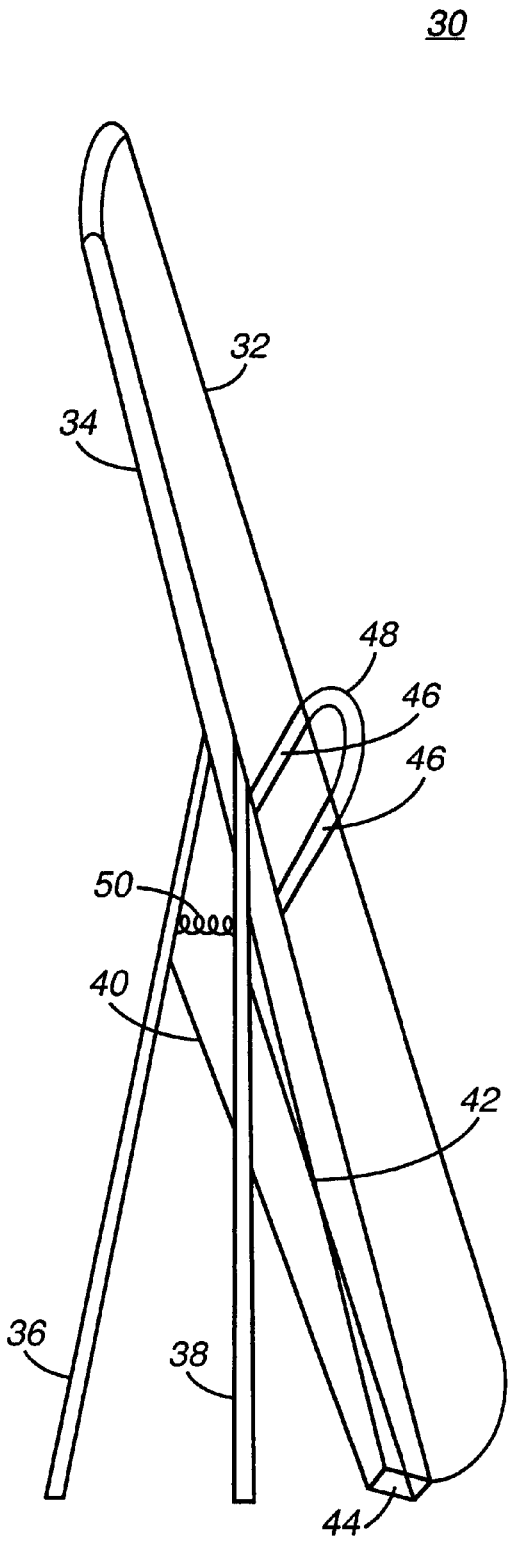
FIG. 2 is a cartoon drawing of a soft sided gun case with retractable legs in accordance with one embodiment of the invention.

FIG. 2 is a cartoon drawing 30 of a soft sided gun case with retractable legs in accordance with one embodiment of the invention. The device comprises gun case 32 having a top and a bottom, a frame 34 connected to the bottom of the gun case 32, the frame 34 having an upper end and a grounded end, and a first leg 36 and a second leg 38 being pivotally held at a pivot point to the frame and further having a foot, each leg being movable from a closed position wherein it lies against the bottom of the gun case 32 to an open position wherein it is pivoted away from the bottom of the gun case 32 and the foot of the first leg 36 being moved away from the foot of the second leg 38. In one embodiment the device further comprises a leg actuating means comprising a first arm 40 affixed to the first leg 36 between its pivoted end and its foot and a second arm 42 affixed to the second leg 38 between its pivoted end and its foot and the first arm 40 and the second arm 42 being connected to an actuating foot 44 which touches the ground when the gun case 32 is placed with its grounded end adjacent the ground and moves the first arm 40 and the second arm 42 upwardly along the frame 34 thus the pivoting the feet of the first leg 36 and second leg 38 away from the frame 34 to an open position. Leg deployment may be effected by pressing the actuating foot 44 to the ground. In another embodiment, the leg actuating means further comprises a biasing means so that when the gun case 32 is lifted upwardly from the ground, the first leg 36 and second leg 38 move to a closed position. Such movement of the legs to the closed position is automatic as a result of the biasing means. The closed position is when the legs are parallel to and in contact with the bottom of the gun case 32 or the frame 34. The biasing means may be a spring 50 connected to the first leg 36 and the second leg 38 which acts to draw the legs together and toward the frame 34 when the gun case 32 is lifted from the ground. In another embodiment a plurality of lateral supports 46 extend from the bottom of the gun case 32 to the top of the gun case 32. The lateral supports 46 provide supplemental rigidity to the sides of the gun case 32, necessary particularly where the gun case 32 is soft-sided. The lateral supports 46 describe a cradle for the firearm, retaining the firearm within easy access inside the gun case 32. The lateral supports 46 may be incorporated into a pair of carrying handles 48.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A gun case with retractable legs, comprising:

a gun case capable of enclosing a gun;

a pair of retractable legs connected to a bottom of the gun case; and a containment sleeve attached along the bottom of the gun case.

2. The gun case of claim 1, further comprising:

a spine contained within the containment sleeve.

3. The gun case of claim 2, further comprising:

a trigger mechanism connected to the spine, between the spine and the pair of retractable legs.

4. The gun case of claim 3, wherein the legs extend when the trigger is operated.

5. The gun case of claim 2, further comprising:

a plurality of lateral supports connected to the spine.

6. The gun case of claim 1, wherein the gun case is a soft sided gun case.

7. The gun case of claim 1, wherein the pair of retractable legs are spring loaded.

8. The gun case of claim 7, wherein the pair of retractable legs automatically retract when the gun case is lifted from the ground.

9. A gun case with retractable legs, comprising:

a gun case having a top and a bottom and capable of enclosing a gun;

a frame connected to the bottom of the gun case, the frame having an upper end and a grounded end;

a first and a second leg being pivotally held at a pivot point to the frame, each leg having a pivoted end pivotally attached to the frame and further having a foot, each leg being movable from a closed position wherein it lies against the bottom of the gun case to an open position wherein it is pivoted away from the bottom of the gun case and the foot of the first leg being moved away from the foot of the second leg; and a plurality of lateral supports extending from the bottom of the gun case to the top of the gun case.

10. The gun case of claim 9, further comprising:

leg actuating means comprising a first arm affixed to the first leg between its pivoted end and its foot and a second arm affixed to the second leg between its pivoted end and its foot and the first arm and the second arm being connected to an actuating foot which touches the ground when the gun case is placed with its grounded end adjacent the ground and moves the first arm and the second arm upwardly along the frame thus the pivoting the feet of the first and second legs away from the frame to an open position.

11. The gun case of claim 10, wherein the leg actuating means further comprises a biasing means so that when the gun case is lifted upwardly from the ground, the first and second legs move to a closed position.

12. The gun case of claim 11, wherein the biasing means is a spring connected to the first leg and the second leg which acts to draw the first and second legs together and toward the frame when the gun case is lifted from the ground.

13. The gun case of claim 9, wherein the plurality of lateral supports is incorporated into a pair of carrying handles.

* * * * *